US007952029B2

(12) United States Patent
Hase et al.

(10) Patent No.: US 7,952,029 B2
(45) Date of Patent: May 31, 2011

(54) INSULATED WIRE AND A WIRING HARNESS

(75) Inventors: Tatsuya Hase, Yokkaichi (JP); Masato Inoue, Yokkaichi (JP); Tsuyoshi Nonaka, Yokkaichi (JP); Masashi Sato, Yokkaichi (JP); Naoaki Sawamura, Yokkaichi (JP); Tetsuya Iwasaki, Yokkaichi (JP); Yukihiro Sakamoto, Yokkaichi (JP)

(73) Assignees: Autonetwork Technologies, Ltd., Mie (JP); Sumitomo Wiring Systems, Ltd., Mie (JP); Sumitomo Electric Industries, Ltd., Osaka (JP)

( * ) Notice: Subject to any disclaimer, the term of this patent is extended or adjusted under 35 U.S.C. 154(b) by 220 days.

(21) Appl. No.: 12/308,884

(22) PCT Filed: Jul. 18, 2007

(86) PCT No.: PCT/JP2007/064208

§ 371 (c)(1),
(2), (4) Date: Jan. 12, 2009

(87) PCT Pub. No.: WO2008/010529

PCT Pub. Date: Jan. 24, 2008

(65) Prior Publication Data

US 2009/0301756 A1 Dec. 10, 2009

(30) Foreign Application Priority Data

Jul. 18, 2006 (JP) ..... 2006-195164

(51) Int. Cl.
*H01B 7/00* (2006.01)

(52) U.S. Cl. ..... 174/110 R; 174/120 R; 174/121 R

(58) Field of Classification Search ..... 174/110 R, 174/120 R, 120 SR, 121 R, 121 A, 36; 428/500, 428/590
See application file for complete search history.

(56) References Cited

U.S. PATENT DOCUMENTS

| | | | | |
|---|---|---|---|---|
| 3,944,717 | A * | 3/1976 | Hacker et al. | 174/23 C |
| 4,218,577 | A * | 8/1980 | Bahder et al. | 174/23 C |
| 4,659,871 | A * | 4/1987 | Smith et al. | 174/113 R |
| 4,852,965 | A * | 8/1989 | Mullin et al. | 385/101 |
| 5,418,272 | A | 5/1995 | Kawabata et al. | |
| 6,339,189 | B1 * | 1/2002 | Caimi | 174/36 |
| 6,495,760 | B1 * | 12/2002 | Castellani et al. | 174/110 R |
| 6,803,517 | B2 * | 10/2004 | Caimi | 174/36 |
| 2002/0001715 | A1 | 1/2002 | Redondo et al. | |

FOREIGN PATENT DOCUMENTS

| | | | |
|---|---|---|---|
| DE | 699 04 353 T2 | | 12/2003 |
| DE | 600 13 196 T2 | | 8/2005 |
| JP | A-4-13744 | | 1/1992 |
| JP | U-5-83939 | | 11/1993 |
| JP | A-10-269855 | | 10/1998 |
| JP | A-11-140242 | | 5/1999 |
| JP | A-11-312418 | | 11/1999 |
| JP | 2000-030544 | * | 1/2000 |
| JP | A-2000-30544 | | 1/2000 |
| JP | B2-3280099 | | 2/2002 |
| JP | A-2004-335263 | | 11/2004 |
| JP | A-2005-44596 | | 2/2005 |

OTHER PUBLICATIONS

Office Action issued in German Patent Application No. 11 2007 001 703.1-34 received on Dec. 6, 2010 (w/English Translation).

* cited by examiner

*Primary Examiner* — William H Mayo, III
(74) *Attorney, Agent, or Firm* — Oliff & Berridge, PLC

(57) ABSTRACT

An insulated wire including a conductor, an inside coat of one or more layers arranged to cover the conductor, and an outside coat arranged to cover the outermost layer of the inside coat, wherein at least the layer of the inside coat which is in contact with the conductor is made from an olefin resin including a functional group, and the outside coatis made from a non-halogenous flame-retardant resin composition. The functional group is preferably one or more groups selected from a carboxylic acid group, an acid anhydrous group, an epoxy group, a hydroxyl group, an amino group, an alkenyl cyclic imino ether group, and a silane group.

11 Claims, No Drawings

INSULATED WIRE AND A WIRING HARNESS

TECHNICAL FIELD

This application is a continuation of PCT/JP2007/064208, filed Jul. 18, 2007, which claims priority to JP 2006-195164, filed Jul. 18, 2006. The disclosures of the prior applications are hereby incorporated by reference herein in their entirety.

The present invention relates to an insulated wire and a wiring harness, and more specifically relates to an insulated wire having a multilayered structure and a wiring harness including the same.

BACKGROUND ART

Conventionally, for an insulated wire used in carrying out wiring of parts for an automobile and electric/electronic equipment, there is widespread use of an insulated wire in which a single layer of a vinyl chloride resin composition to which a halogenous flame retardant is added is arranged to cover a conductor.

However, there is a problem that the vinyl chloride resin composition includes halogen elements, so that it emits harmful halogenous gas into the atmosphere in case of car fire or at the time of combustion for disposing of electric/electronic equipment by incineration, causing environmental pollution.

Therefore, from the view point of reducing loads on the global environment, the vinyl chloride resin composition has been recently replaced with a so-called non-halogenous flame-retardant resin composition, which is prepared by adding a metallic hydrate such as magnesium hydroxide as a non-halogenous flame retardant to an olefin resin such as polyethylene.

However, the olefin resin is essentially combustible, and the non-halogenous flame retardant is inferior to a halogenous flame retardant in effect of flame retardancy. For these reasons, the non-halogenous flame-retardant resin composition requires a large amount of metallic hydrate to be added thereto in order to secure sufficient flame retardancy, thus bringing a disadvantage that mechanical properties represented by wear resistance remarkably degrade.

In order to overcome such a problem, Japanese Patent Gazette No. 3280099, for example, discloses an art to increase an affinity between a base resin and a metallic hydrate and improve mechanical properties such as wear resistance by using a plurality of olefin resins and rubbers as a base resin in which a specific functional group is further contained by a specific amount.

DISCLOSURE OF THE INVENTION

Problems to be Solved by the Invention

The insulated wire in which a single layer of the non-halogenous flame-retardant resin composition is arranged to cover a conductor is susceptible to improvement, so that an improvement is made as follows.

That is, an attempt has been recently made to reduce an additive amount of the non-halogenous flame retardant such as a metallic hydrate by improving the resin ingredients in the resin composition in a variety of ways. However, an extremely large amount of the non-halogenous flame retardant is still required compared with a case in which a halogenous flame retardant is used.

Therefore, the insulated wire having the conventional structure is still susceptible to improvement since the mechanical properties such as wear resistance are not fully satisfying yet due to a large amount of the filled metallic hydrate.

An object of the present invention is to overcome the problems described above and to provide an insulated wire which possesses flame retardancy, and wear resistance which is superior to the conventional insulated wire.

Means to Solve the Problem

To achieve the objects and in accordance with the purpose of the present invention, an insulated wire according to the present invention includes a conductor, an inside coat of one or more layers which is arranged to cover the conductor, and an outside coat which is arranged to cover the outermost layer of the inside coat, wherein at least the layer of the inside coat which is in contact with the conductor is made from an olefin resin including a functional group, and the outside coat is made from a non-halogenous flame-retardant resin composition.

The functional group is preferably one or more sorts of groups selected from a carboxylic acid group, an acid anhydrous group, an epoxy group, a hydroxyl group, an amino group, an alkenyl cyclic imino ether group, and a silane group.

It is also preferable that the non-halogenous flame-retardant resin composition includes a flame retardant and a polymer component, a part weight ratio of the flame retardant to the polymer component being 5-200 to 100.

It is also preferable that the non-halogenous flame-retardant resin composition contains an olefin resin as a base resin.

It is also preferable that the outside coat is in the range of 10 to 300 μm in thickness, and at least the layer of the inside coat which is in contact with the conductor is in the range of 5 to 100 μm in thickness.

A wiring harness according to the present invention includes the insulated wire according to the present invention.

EFFECTS OF THE INVENTION

The insulated wire according to the present invention includes a covering material having a multilayered structure, in which at least the layer which is in contact with the conductor (hereinafter, referred to as an "innermost layer") is made from the olefin resin including the functional group.

For example, in a conventional insulated wire having a single-layered structure in which a conductor is covered with a single layer of a non-halogenous flame-retardant resin composition containing metallic hydrate as a flame retardant and a functional group, the functional group in the covering material is mainly used for improving an affinity between the base resin and the metallic hydrate.

Meanwhile, in the insulated wire according to the present invention, the olefin resin from which the innermost coat is made does not contain any additive such as a flame retardant, or contains an additive such as a flame retardant as little as possible compared with that contained in the covering material of the insulated wire having the single-layered structure. Accordingly, the functional group included in the olefin resin is mainly used for improving adherence of the innermost coat to the conductor.

Accordingly, the insulated wire according to the present invention achieves improved adherence of the innermost coat to the conductor, and displays excellence in mechanical properties such as wear resistance and damage resistance as further having the outside coat.

In addition, since the outside coat is made from the non-halogenous flame-retardant resin composition, flame retardancy is secured.

If the functional group is one or more sorts of groups selected from the carboxylic acid group, the acid anhydrous group, the epoxy group, the hydroxyl group, the amino group, the alkenyl cyclic imino ether group and the silane group, the adherence of the innermost layer to the conductor is more improved, which accordingly improves the properties described above.

If the non-halogenous flame-retardant resin composition includes the flame retardant and the polymer component, a part weight ratio of the flame retardant to the polymer component being 5-200 to 100, an preferable flame retardancy of the insulated wire is achieved.

If the non-halogenous flame-retardant resin composition includes the olefin resin as the base resin, the adherence of the inside coat to the outside coat is easily and advantageously improved. The advantageous property is remarkably seen especially when the covering material has a two-layered structure.

If the outside coat and the innermost layer fall within the respective thicknesses described above, the non-halogenous insulated wire is balanced in the properties described above.

Meanwhile, the wiring harness according to the present invention has the insulated wire which has flame retardancy and is excellent in mechanical properties such as wear resistance compared with the conventional insulated wire, so that advantageous properties such as scratch resistance are displayed even when the covering material of the insulated wire is scratched by a terminal or other elements in routing the insulated wire during producing of the harness. In addition, an advantageous effect such as high reliability can be ensured over a long period of time when using the harness since the insulated wire possesses wear resistance.

BEST MODE FOR CARRYING OUT THE INVENTION

A detailed description of one preferred embodiment of the present invention will now be provided. Hereinafter, in the description, an insulated wire according to the preferred embodiment of the present invention is sometimes referred to as the "present wire," and a wiring harness according to the preferred embodiment of the present invention is sometimes referred to as the "present wiring harness."

1. Non-halogenous Insulated Wire

The present wire according to the preferred embodiment of the present invention has a multilayered structure such that a conductor is covered with an inside coat and an outermost layer of the inside coat is covered with an outside coat.

1.1 Conductor

For the conductor, a single metallic wire, a strand of a number of individual metallic wires and a strand of a number of individual metallic wires on which compression is further applied are preferably used. In addition, the diameter and the material of the conductor are not limited in particular and may be chosen appropriately when necessary.

1.2 Inside Coat

In the present wire, the inside coat may be formed of one layer or may be formed of two or more layers; however, the inside coat is preferably formed of one layer in view of a relatively simple structure and excellent manufacturability.

When the inside coat is formed of two or more layers, the materials and the thicknesses of the two or more layers maybe entirely the same, or may be different from each other.

However, in the present wire, at least the layer of the inside coat which is in contact with the conductor (i.e., the innermost layer) needs to be made from an olefin resin including a functional group.

For the olefin resin, a propylene resin such as polypropylene, low-density polyethylene, linear low-density polyethylene, high-density polyethylene, an ethylene-alpha-olefin copolymer, an ethylene-vinyl ester copolymer, and an ethylene-alpha, beta-unsaturated carboxylic acid alkyl ester copolymer are preferably used. They may be contained by one sort alone, or more than one sort in combination.

For the functional group, a carboxylic acid group, an acid anhydrous group, an epoxy group, a hydroxyl group, an amino group, an alkenyl cyclic imino ether group and a silane group are preferably used. They may be contained by one sort alone, or more than one sort in combination. Among them, the carboxylic acid group, the acid anhydrous group and the silane group are more preferable from the view point of developing excellent adherence to the conductor.

The weight percentage of the functional group contained in the olefin resin is preferably in the range of 0.1 to 10 wt %, and more preferably in the range of 0.3 to 5 wt %. This is because the present wire becomes well balanced between mechanical properties such as wear resistance and a stripping property such that the covering material is easily stripped when processing a terminal if the functional group is in these ranges.

For a manner of introducing the functional group into the olefin resin, a manner of introducing the functional group in the form of a graft-modified copolymer, and a manner of introducing the functional group in the form of a copolymer of olefin and a functional group-containing compound are preferably used.

For the compound for introducing the carboxylic acid group and/or the acid anhydrous group, an alpha, beta-unsaturated dicarboxylic acid such as a maleic acid, a fumaric acid, a citraconic acid and an itaconic acid or anhydrides thereof, and an unsaturated monocarboxylic acid such as an acrylic acid, a methacrylic acid, a fran acid, a crotonic acid, a vinylacetic acid and a pentane acid are preferably used.

For the compound for introducing the epoxy group, glycidyl acrylate, glycidyl methacrylate, an itaconic monoglycidyl ester, a butene tricarboxylic acid monoglycidyl ester, a butene tricarboxylic acid diglycidyl ester and a butene tricarboxylic acid triglycidyl ester, glycidyl esters such as an alpha-chloroacrylic acid, a maleic acid, a crotonic acid and a fumaric acid, or glycidyl ethers such as a vinyl glycidyl ether, an allyl glycidyl ether, a glycidyl oxyethyl vinyl ether and a styrene-p-glycidyl ether, and p-glycidyl styrene are preferably used.

For the compound for introducing the hydroxyl group, 1-hydroxypropyl (meth) acrylate, 2-hydroxypropyl (meth) acrylate, and hydroxyethyl (meth) acrylate are preferably used.

For the compound for introducing the amino group, aminoethy (meth)acrylate, propylaminoethyl (meth)acrylate, dimethylaminoethyl (meth)acrylate, diethylaminoethyl (meth)acrylate, dibutylaminoethyl (meth)acrylate, aminopropyl (meth)acrylate, phenylaminoethyl (meth)acrylate, and cyclohexylaminoethyl (meth)acrylate are preferably used.

For the compound for introducing the alkenyl cyclic imino ether group, 2-vinyl-2-oxazolin; 2-isopropenyl-2-oxaxolin; 2-vinyl-5, 6-dihydro-4H-1, 3-oxazine; and 2-isopropenyl-5, 6-dihydro-4H-1, 3-oxazine are preferably used.

For the compound for introducing the silane group, an unsaturated silan compound such as vinyltrimethoxysilane, vinyltriethoxysilane, vinyltriacetylsilane, and vinyltrichlorosilane are preferably used.

To the olefin resin, there may be added various additives generally used in a resin molding material such as a filler (e.g., an oxide and a silicate), a thermal stabilizer (e.g., an antioxidant and an antiaging agent), a metal deactivator (e.g., a copper inhibitor), a lubricant, a plasticizer, an antistatic agent, a flame retardant, a flame-retardant auxiliary agent, a coloring agent, a softener, a cross-linking agent, and a cross-linking auxiliary agent, if they are added within the ranges of not departing from the gist of the present invention.

The part weight of the additives contained in the olefin resin is preferably 30 part weight or less and more preferably 20 part weight or less with respect to 100 part weight of the olefin resin.

In the above description, the materials for the innermost layer are explained. Meanwhile, in the present wire, the inside coat may be formed of two or more layers. When the inside coat is formed of two or more layers, the materials for layers of the inside coat other than the innermost layer may be the same as the materials for the innermost layer.

Besides, the layers other than the innermost layer may be formed of a layer which includes a functional group or a layer which do not include a functional group. This is because the layers are not in direct contact with the conductor.

In the present wire, the inside coat is preferably in the range of 5 to 100 μm in thickness, and more preferably in the range of 10 to 80 μm.

1. 3 Outside Coat

In the present wire, the outside coat is made from a non-halogenous flame-retardant resin composition.

Besides, it is essential only that the non-halogenous flame-retardant resin composition should substantially contain no halogen element in the composition and have flame retardancy required for the wire.

For the non-halogenous flame-retardant resin composition, a composition which contains at least a non-halogenous base resin and a flame retardant is preferably used.

For the base resin, a propylene resin such as polypropylene, an olefin resin such as low-density polyethylene; linear low-density polyethylene; high-density polyethylene; an ethylene-alpha-olefin copolymer, an ethylene-vinyl ester copolymer; and an ethylene-alpha, beta-unsaturated carboxylic acid alkyl ester copolymer, a polyester resin such as a polyamid resin; polyethylene terephthalate; and polybutylene terephthalate, an engineering plastic such as a polysulfone resin; a polyarylate resin; a polyphenylenesulfide resin; and a thermoplastic polyurethan resin, and a thermoplastic elastomer such as an olefin elastomer; a styrene elastomer; an urethane elastomer; a polyester elastomer; a polyamide elastomer; an ionomer elastomer; a fluoro elastomer; 1,2-polybutadiene; and trans-1, 4-polyisoprene are preferably used. They may be contained by one sort alone, or more than one sort in combination.

For the base resin, the olefin resin is preferably used. This is because if the inside and outside coats contain a resin of the same family, adherence to each other can be improved.

The composition may further contain an ethylenepropylene rubber, a butadiene rubber, an isoprene rubber, a crude rubber, a nitrile rubber and an isobutylene rubber alone or in combination in addition to the above-described base resin.

The base resin and/or the rubber may be modified by acid such as unsaturated carboxylic acid and a derivative thereof. Examples of the unsaturated carboxylic acid include a maleic acid and a fumaric acid. Examples of the derivative of the unsaturated carboxylic acid include a maleic acid anhydride, a maleic acid monoester and a maleic acid diester. They may be used by one sort alone, or more than one sort in combination.

For the flame retardant, a metallic hydrate, a phosphoric ester compound, a silicone compound, an N-containing compound (e.g., an N-containing triazine compound and an N-containing guanidine compound) and an aromaic resin are preferably used. They may be used by one sort alone, or more than one sort in combination.

In the composition, the flame retardant is contained preferably in the range of 5 to 250 part weight with respect to 100 part weight of the polymer component contained in the composition, and more preferably in the range of 5 to 200 part weight, depending on the variety.

For the flame retardant, the metallic hydrate is preferably used. To be specific, the metallic hydrate is a compound having a hydroxyl group or crystalline water, such as magnesium hydroxide, aluminum hydroxide, zirconium hydroxide, hydrated magnesium silicate, hydrated aluminum silicate, basic magnesium carbonate and hydrotalcite. In particular, the magnesium hydroxide and the aluminum hydroxide are preferable because they are effective in flame retardancy and heat resistance, and advantageous from an economical standpoint.

In addition, the surface of the metallic hydrate may be subject to surface finishing using a finishing agent such as a fatty acid, fatty acid metallic salt, a silane coupling agent and a titanate coupling agent. Besides, in the case of using the metallic hydrate subjected to the surface finishing, the metallic hydrate which is previously subjected to the surface finishing using the finishing agent may be blended into the composition, or the metallic hydrate yet to be finished may be blended into the composition together with the finishing agent and be subjected to the surface finishing, which is not limited in particular.

The composition may contain one or more than one sort of additives in addition to the flame retardant as appropriate if they are added within the ranges of not departing from the gist of the present invention. Examples of the additives include an antioxidant (e.g., a hindered phenolic antioxidant and a sulfurous antioxidant), a metallic oxide (e.g., an oxide of metal such as zinc, aluminum, magnesium, lead and tin) , a metal deactivator (a copper inhibitor), an inorganic filler (e.g., calcium sulfate, calcium silicate, clay, diatomaceous earth, talc, almina, silica sand, glass powder, iron oxide, metal powder, graphite, silicon carbide, silicon nitride, silica, boron nitride, aluminum nitride, carbon black, mica, a glass plate, sericite, pyrophyllite, aluminum flake, graphite, Shirasu-balloon, metal balloon, glass balloon, pumice, glass fiber, carbon fiber, whisker, metal fiber, graphite fiber, silicon carbide fiber, asbestos and wallastonite), an ultraviolet absorber, an ultraviolet-concealing agent, a flame-retardant auxiliary agent, a cross-linking agent, a cross-linking auxiliary agent, a processing aid (e.g., a lubricant and wax), and a coloring pigment.

In the present wire, it is preferable that the outside coat is in the range of 10 to 300 μm in thickness, and more preferably in the range of 50 to 250 μm in thickness.

The description of a basic configuration of the present wire is provided above. Besides, from the viewpoint of further improving heat resistance, the outside coat and the inside coat may be cross-linked by the use of, for example, radiation, a peroxide and a silane cross-linking agent.

In addition, in the present wire, the inside coat may be directly covered with the outside coat, or an intermediate material, for example, a shielded conductor such as a braid and a metallic foil may be interposed between the inside coat and the outside coat so as to be covered with the outside coat.

2. Production process of the present wire

A production process of the present wire is not limited in particular, and a publicly known production process can be used. For example, firstly, the materials for an inside coat and the materials for an outside coat are prepared by blending the respective ingredients, and the other ingredients and additives as appropriate, and dry-blending them with the use of a regular tumbler, or melting and kneading them so as to be dispersed uniformly with the use of a regular kneader such as a Banbury mixer. a pressure kneader, a kneading extruder, a twin-screw extruder and a roll.

Next, for example, the conductor is covered with one or more than one layers of the materials for an inside coat in a given thickness with the use of an extrusion molding machine. Thereafter, the thus-obtained inside coat is covered with the materials for an outside coat in a given thickness, whereby the present wire can be produced. Additionally, arbitrary application of radiation to the produced present wire allows formation of cross-links in the covering material.

3. Wiring Harness

The present wiring harness is prepared by covering a wire bundle including at least the present wires with a wiring-harness protective material. a roll.

The wiring-harness protective material is used for covering the wire bundle and protecting the wire bundle from an external environment.

For a base material from which the wiring-harness protective material is made, a non-halogenous resin composition is preferably used.

For the non-halogenous resin composition, polyolefin flame-retardant resin compositions which are prepared by adding various additives such as a non-halogenous flame retardant to polyolefins such as polyethylene, polypropylene and a propylene-ethylene copolymer are preferably used.

The wiring-harness protective material is formed so as to have its base material tape-shaped and at least one side of the base material applied with an adhesive, or so as to have its base material tube-shaped or sheet-shaped. The shape can be selected appropriately as usage.

EXAMPLE

A description of the present invention will now be provided specifically with reference to Examples; however, the present invention is not limited hereto.

Test material, manufacturer, and other factors

Test materials used in the present Examples are given along with manufacturers, trade names, and other factors.

Polymer components

High-density polyethylene (HDPE) [manuf.: Prime Polymer Co., Ltd., trade name: "HI-ZEX 5000S"]

Polypropylene (PP) [manuf.: Prime Polymer Co., Ltd., trade name: "Prime Polypro E-150GK"]

Ethylene-vinyl acetate copolymer (EVA) [manuf.: DuPont-Mitsui Polychemicals Co., Ltd., trade name: "EVAFLEX EV360"]

Ionomer resin (in the Examples, an ionomer resin is used where cross-links are formed between molecules of an ethylene-methacrylic acid copolymer via zinc ions) [manuf.: DuPont-Mitsui Polychemicals Co., Ltd., trade name: "HIMILAN1706"]

Olefinic thermoplastic elastomer (TPO) [manuf.: Prime Polymer Co., Ltd., trade name: "PRIME TPO T310E"]

Polyamid 6 (PA6)[manuf.: DuPont, trade name: "ZytelFN727"]

Polycarbonate resin (PC) [manuf.: Mitsubishi Engineering-Plastics Corporation., trade name: "IupilonS-2000"]

Polybutylene terephthalate (PBT) [manuf.: Toray Industries Inc., trade name: "TORAYCON 1401 X06"]

Polypropylene into which maleic anhydride is introduced (PP into which maleic anhydride is introduced) [manuf.: Mitsui Chemicals, Inc., trade name: "ADMER QE060"]

Very low-density polyethylene into which maleic anhydride is introduced (VLDPE into which maleic anhydride is introduced) [manuf.: Mitsui Chemicals, Inc., trade name: "ADMER XE070"]

Ethylene-vinyl acetate copolymer into which maleic anhydride is introduced (EVA into which maleic anhydride is introduced) [manuf.: Mitsui Chemicals, Inc., trade name: "ADMER VE300"]

Ethylene-ethylacrylate copolymer into which maleic anhydride is introduced (EEA into which maleic anhydride is introduced) [manuf.: Arkema Inc., trade name: "BONDINE AX8390"]

Styrene-ethylene/butylene-stylene block copolymer into which maleic anhydride is introduced (SEBS into which maleic anhydride is introduced) [manuf.: Kraton Polymers LLC., trade name: "FG1901X"]

Ethylene propylene rubber into which maleic anhydride is introduced (EPR into which maleic anhydride is introduced) [manuf. :JSR Corporation, trade name: "EP51"]

Filler components

Magnesium hydroxide (a flame retardant) [manuf.: Martinswerk GmbH, trade name: "MAGNIFIN H10IV"]

Melamin cyanurate [manuf.: DSM Japan K. K., trade name: "melapurMC15"]

Clay [manuf.: SHIRAISHI CALCIUM KAISHA, LTD., tradename: "OPTIWHITE"]

Calcium carbonate [manuf.: SHIRAISHI CALCIUM KAISHA, LTD., trade name: "HAKUENKA CCR"]

Talc [manuf.: Nippon Talc Co., Ltd., trade name: "MS-P"]

Additives

Antioxidant [Manuf.: Ciba Specialty Chemicals Inc., trade name: "Irganox 1010"]

Metal deactivator [Manuf. : Ciba Specialty Chemicals Inc. trade name: "Irganox MD1024"]

Preparation of the materials for an inside coat, the materials for an outside coat, and the insulated wires Firstly, the respective ingredients shown in the below-described tables were kneaded with the use of a double-shaft extruder, and pellets of the materials for an inside coat and the materials for an outside coat which are to be used for the insulated wires according to the present Examples and Comparative Examples were prepared.

Next, conductors (cross sectional area: 0.5 $mm^1$), which were soft-copper twisted wires made by twisting seven soft copper wires together, were covered with the materials for an inside coat of one layer with the use of an extrusion molding machine and inside coats were formed, and further the thus-obtained inside coats were covered with the materials for an outside coat and outside coats were formed.

In this manner, the preparation was made for the insulated wires according to the present Examples and the Comparative Examples each of which has the two-layered structure in which the conductor was covered with the inside coat and the outside coat in this order. The entire thicknesses of the inside coats and the outside coats were arranged to be 0.20 mm. The thicknesses of the respective inside coats were arranged as shown in the below-described tables.

Assessment of the Wires

The insulated wires according to the present Examples and the Comparative Examples prepared as above were subjected to a flame-retardancy test, a wear-resistance test, and an insulation level test for assessment of the insulated wires. Hereinafter, descriptions of procedures of the respective tests and assessment criteria will be provided.

Flame-retardancy Test

The flame-retardancy test was performed based on JASOD611-94. To be more specific, the insulated wires according to the present Examples and the Comparative Examples were cut into test specimens 300 mm long.

Then, each of the test specimens was placed in an iron test box to be held horizontal, and the tip of a reducing flame by a Bunsen burner having a caliber of 10 mm was placed beneath the center of the test specimen within 30 seconds until it burned, and then, after the flame was calmly removed, an afterflame time of the test specimen was measured. The test specimen whose afterflame time was within 15 seconds was regarded as passed, and the one whose afterflame time was over 15 seconds was regarded as failed.

Wear-resistance Test

The wear-resistance test was performed by a blade-reciprocating method based on JASO D611-94. To be more specific, the insulated wires according to the present Examples and the Comparative Examples were cut into test specimens 750 mm long.

Then, at a room temperature of 25° C., a blade was made to reciprocate in a direction of its shaft over a length of 10 mm on a surface of the covering material of each of the test specimens which was fixed to a table, and the number of reciprocation before the blade touches the conductor due to the wearing out of the covering material was counted. A load imposed on the blade was set at 7N, and the blade was made to reciprocate at a speed of 50 times/minute.

Then, the test specimen was moved by 100 mm and rotated 90 degrees clockwise, and the measurement as described above was repeated. The measurement was performed three times in total with respect to one test specimen, and the test specimen whose smallest reciprocation number was 200 or more was regarded as passed, and the test specimen whose smallest reciprocation number was below 200 was regarded as failed.

Insulation Level Test for the Insulating Materials

The insulation level test for the insulating materials was performed by the following manner. The insulated wires according to the present Examples and the Comparative Examples were cut into test specimens 900 mm long. Thereafter, the covering material on both ends of each test specimen was stripped off 25 mm long each, and then, each test specimen was kept to be straight without being tempered and was mounted on the iron bar having a diameter of 3.2 mm so as to intersect perpendicularly with the iron bar.

Then, by using a lever advantage 10, a load of the iron bar is imparted on each test specimen with the load being increased at 22.2N (2.27 kgf) per minute, and the load was measured at the time when the conductor touched the iron bar.

The test specimen was moved by 50 mm and rotated 90 degrees clockwise upon measurement of one portion of each test specimen, and the measurement as described above was repeated. The measurement was performed for four portions with respect to one test specimen. The measurement was performed three times in total with respect to one test specimen, and the test specimen whose average load was 20N or more was regarded as passed, and the test specimen whose average load was below 20N was regarded as failed.

Component ratios of the materials for an inside coat and the materials for an outside coat and assessment results of the insulated wires according to the present Examples and the Comparative Examples are shown in Tables 1 and 2 below.

TABLE 1

| | | Example | | | | | | | | | | | | | | | |
|---|---|---|---|---|---|---|---|---|---|---|---|---|---|---|---|---|---|
| | | 1 | | 2 | | 3 | | 4 | | 5 | | 6 | | 7 | | 8 | |
| | | outside coat | inside coat | outside coat | inside coat | outside coat | inside coat | outside coat | inside coat | outside coat | inside coat | outside coat | inside coat | outside coat | inside coat | outside coat | inside coat |
| Polymer | HDPE | 100 | — | — | — | — | — | — | — | 70 | — | — | — | — | — | — | — |
| | PP | — | — | 80 | — | — | — | 50 | — | — | — | — | — | — | — | 50 | — |
| | EVA | — | — | — | — | 95 | — | — | — | — | — | — | — | — | — | — | — |
| | Ionomer resin | — | — | — | — | — | — | — | — | 30 | — | — | — | 10 | — | — | — |
| | TP0 | — | — | — | — | — | — | 50 | — | — | — | — | — | — | — | — | — |
| | PA6 | — | — | — | — | — | — | — | — | — | — | — | — | 90 | — | — | — |
| | PC | — | — | — | — | — | — | — | — | — | — | — | — | — | — | 40 | — |
| | PBT | — | — | — | — | — | — | — | — | — | — | 90 | — | — | — | — | — |
| | PP (maleic anhydride introduced) | — | — | — | 100 | — | — | — | — | — | 100 | — | — | — | 100 | 10 | 100 |
| | VLDPE (maleic anhydride introduced) | — | 100 | — | — | — | — | — | — | — | — | — | 100 | — | — | — | — |
| | EVA (maleic anhydride introduced) | — | — | — | — | — | 100 | — | — | — | — | 10 | — | — | — | — | — |
| | EEA (maleic anhydride introduced) | — | — | — | — | — | — | — | 100 | — | — | — | — | — | — | — | — |
| | SEBS (maleic anhydride introduced) | — | — | 20 | — | — | — | — | — | — | — | — | — | — | — | — | — |
| | EPR (maleic anhydride introduced) | — | — | — | — | 5 | — | — | — | — | — | 10 | — | — | — | — | — |

TABLE 1-continued

| | | Example | | | | | | | | | | | | | | | |
|---|---|---|---|---|---|---|---|---|---|---|---|---|---|---|---|---|---|
| | | 1 | | 2 | | 3 | | 4 | | 5 | | 6 | | 7 | | 8 | |
| | | outside coat | inside coat | outside coat | inside coat | outside coat | inside coat | outside coat | inside coat | outside coat | inside coat | outside coat | inside coat | outside coat | inside coat | outside coat | inside coat |
| Filler | Magnesium hydroxide | 100 | — | 120 | — | 200 | — | 150 | — | 100 | — | — | — | — | — | — | — |
| | Melamine cyanurate | — | — | — | — | — | — | — | — | — | — | 5 | — | 20 | — | 30 | — |
| | Clay | — | — | — | — | — | — | — | 20 | — | — | — | — | — | — | — | — |
| | Calcium carbonate | — | — | — | 5 | — | — | — | — | — | — | — | — | — | — | — | — |
| | Talc | — | — | — | — | — | — | — | — | — | — | — | 5 | — | — | — | — |
| Additive | Antioxidant | 0.5 | 0.2 | 0.5 | 0.2 | 0.5 | — | 0.5 | — | 0.5 | — | 0.5 | 0.2 | 0.5 | — | 0.5 | 0.2 |
| | Metal deactivator | 0.2 | 0.1 | 0.2 | 0.1 | 0.2 | — | 0.2 | — | 0.2 | — | 0.2 | 0.1 | 0.2 | — | 0.2 | 0.1 |
| | Thickness of inside coat (μm) | 40 | | 40 | | 40 | | 40 | | 40 | | 40 | | 40 | | 40 | |
| Assessment | Flame retardancy | passed | | passed | | passed | | passed | | passed | | passed | | passed | | passed | |
| | Wear resistance (number of times) | 800 | | 1200 | | 300 | | 400 | | 650 | | 1800 | | 2100 | | 500 | |
| | Insulation level | passed | | passed | | passed | | passed | | passed | | passed | | passed | | passed | |

TABLE 2

| | | Comparative Example | | | | | |
|---|---|---|---|---|---|---|---|
| | | 1 | | 2 | | 3 | |
| | | outside coat | inside coat | outside coat | inside coat | outside coat | inside coat |
| Polymer | HDPE | — | — | — | 100 | — | — |
| | PP | — | — | 100 | — | 50 | — |
| | EVA | 100 | 100 | — | — | — | — |
| | Ionomer resin | — | — | — | — | — | — |
| | TP0 | — | — | — | — | 40 | — |
| | PA6 | — | — | — | — | — | — |
| | PC | — | — | — | — | — | — |
| | PBT | — | — | — | — | — | — |
| | PP (maleic anhydride introduced) | — | — | — | — | — | 100 |
| | VLDPE (maleic anhydride introduced) | — | — | — | — | — | — |
| | EVA (maleic anhydride introduced) | — | — | — | — | — | — |
| | EEA (maleic anhydride introduced) | — | — | — | — | — | — |
| | SEBS (maleic anhydride introduced) | — | — | — | — | — | — |
| | EPR (maleic anhydride introduced) | — | — | — | — | 10 | — |
| Filler | Magnesium hydroxide | 120 | — | 120 | — | — | — |
| | Melamine cyanurate | — | — | — | — | — | — |
| | Clay | — | — | — | — | — | — |
| | Calcium carbonate | — | — | — | — | — | — |
| | Talc | — | — | — | — | — | — |
| Additive | Antioxidant | 0.5 | — | 0.5 | — | 0.5 | 0.2 |
| | Metaldeactivator | 0.2 | — | 0.2 | — | 0.2 | 0.1 |
| | Thickness of inside layer (μm) | 40 | | 40 | | 40 | |
| Assessment | Flame retardancy | passed | | passed | | failed | |
| | Wear resistance (number of times) | 80 | | 180 | | 450 | |
| | Insulation level | failed | | failed | | passed | |

According to the above tables, it was shown that the insulated wires according to the Comparative Examples gave results of "failed" in any of the assessment items of flame retardancy, wear resistance and insulation level.

To be specific, the insulated wires according to Comparative Examples 1 and 2 have the inside coats which are not made from the resin including the functional group. Therefore, due to the unfavorable adherence between the conductors and the inside coats, the insulated wires according to Comparative Examples 1 and 2 are inferior in wear resistance and insulation level although stripping properties of the covering materials of the terminals of the insulated wires may be favorable.

Further, the insulated wire according to Comparative Example 3 has the outside coat not containing the flame retardant while having the inside coat containing the resin including the functional group. Therefore, it is found that the insulated wire according to Comparative Example 3 is inferior in flame retardancy.

Meanwhile, the insulated wires according to the present Examples are found superior in all of flame retardancy, wear resistance, and insulation level.

The invention claimed is:

1. An insulated wire comprising:

a conductor;

an inside coat of one or more layers, which is arranged to cover the conductor; and an outside coat which is arranged to cover the outermost layer of the inside coat, wherein at least the layer of the inside coat which is in contact with the conductor is made from an olefin resin comprising:

a functional group, a weight percentage of the functional group being from 0.1 to 10 wt %; and a flame retardant additive, a part weight ratio of the flame retardant additive to the olefin resin being from 0-30 to 100; and the outside coat is made from a non-halogenous flame-retardant resin composition comprising:

a flame retardant; and a polymer component, a part weight ratio of the flame retardant to the polymer component being from 5-200 to 100.

2. The insulated wire according to claim 1, wherein the functional group is one or more sorts of groups selected from a carboxylic acid group, an acid anhydrous group, an epoxy group, a hydroxyl group, an amino group, an alkenyl cyclic imino ether group, and a silane group.

3. The insulated wire according to claim 2, wherein the non-halogenous flame-retardant resin composition contains an olefin resin as a base resin.

4. The insulated wire according to claim 2, wherein the outside coat is in the range of 10 to 300 μm in thickness, and at least the layer of the inside coat which is in contact with the conductor is in the range of 5 to 100 μm in thickness.

5. A wiring harness comprising the insulated wire according to claim 2.

6. The insulated wire according to claim 1, wherein the non-halogenous flame-retardant resin composition contains an olefin resin as a base resin.

7. The insulated wire according to claim 6, wherein the outside coat is in the range of 10 to 300 μm in thickness, and at least the layer of the inside coat which is in contact with the conductor is in the range of 5 to 100 μm in thickness.

8. A wiring harness comprising the insulated wire according to claim 6.

9. The insulated wire according to claim 1, wherein the outside coat is in the range of 10 to 300 μm in thickness, and at least the layer of the inside coat which is in contact with the conductor is in the range of 5 to 100 μm in thickness.

10. A wiring harness comprising the insulated wire according to claim 9.

11. A wiring harness comprising the insulated wire according to claim 1.

* * * * *